United States Patent [19]

Kitamura

[11] 4,222,206

[45] Sep. 16, 1980

[54] EARTHQUAKE RESISTANT, EVEN LOADED MAN-MADE LAND STRUCTURE AND METHOD OF MAKING SAME

[76] Inventor: Akinori Kitamura, 259, Kajigaya Tozuka-ku, Yokohama, Kanagawa-ken, Japan

[21] Appl. No.: 1,306

[22] Filed: Jan. 5, 1979

[51] Int. Cl.[2] ..... E02D 27/34; E04H 9/02

[52] U.S. Cl. ..... 52/167; 405/229

[58] Field of Search ..... 405/229, 303; 52/167, 52/292, 126, 169.1

[56] References Cited

U.S. PATENT DOCUMENTS 845,046 2/1907 Bechtold ..... 52/167

1,847,820 3/1932 De Montalk ..... 52/167

3,748,800 7/1973 Glickensberg ..... 52/167

*Primary Examiner*—Roy D. Frazier

*Assistant Examiner*—Alexander Grosz

*Attorney, Agent, or Firm*—Koda and Androlia

[57] ABSTRACT

An earthquake resistant, even loaded man-made land structure including an open container provided in the earth, a plate slidably provided in and enclosing the opening of the container, at least one layer of sand provided between the plate and the container, a means for introducing hydraulic fluid into the sand for maintaining the hydraulic fluid under pressure and dirt provided on top of the plate and filling the remainder of the container.

5 Claims, 11 Drawing Figures

EARTHQUAKE RESISTANT, EVEN LOADED MAN-MADE LAND STRUCTURE AND METHOD OF MAKING SAME

BACKGROUND OF THE INVENTION

1. Field of the Invention

This invention relates to earthquake proof structures and more particularly to earthquake proof structures which are utilized to support buildings, vegetation and the like.

2. Prior Art

In the prior art there exists several ways to build buildings which increase the probability of the building surviving an earthquake. Such structures are for the purpose of providing a building which will survive an earthquake when it is subjected to one but does not solve the basic problem, namely isolating the building or structure from the effects of earthquakes.

SUMMARY OF THE INVENTION

Accordingly, it is the general object of the present invention to provide a structure which isolates those things provided on the structure from the effects of an earthquake.

It is another object of the present invention to provide an earthquake resistant even loaded man-made land structure.

It is still another object of the present invention to provide a method for making an earthquake resistant, even loaded man-made land structure.

In keeping with the principles of the present invention, the objects are accomplished by a unique earthquake resistant, even loaded man-made land structure including an open container provided in the earth, a plate slidably provided in and enclosing the opening in the container, at least one layer of sand provided between the plate and the bottom of the container, a means for introducing hydraulic fluid into the sand and for maintaining the hydraulic fluid under pressure and dirt provided on top of the plate and filling the remainder of the container.

BRIEF DESCRIPTION OF THE DRAWINGS

The above mentioned features and objects of the present invention will be more apparent with reference to the following description taken in conjunction with the accompanying drawings, wherein like reference numerals denote like elements, and in which:

FIG. 6 is a ground layout of the construction of the fixed foundation as well as the construction of the floating foundation for the earthquake resistant man-made land structure in accordance with the teachings of the present invention;

FIG. 8 is an enlarged plan view of the construction of the anti-earthquake oil pressure system (8) in FIG. 5;

FIG. 9 is an enlarged plan view of the construction of the anti-earthquake oil pressure system (9) in FIG. 5;

DETAILED DESCRIPTION OF THE INVENTION

Figure 3:
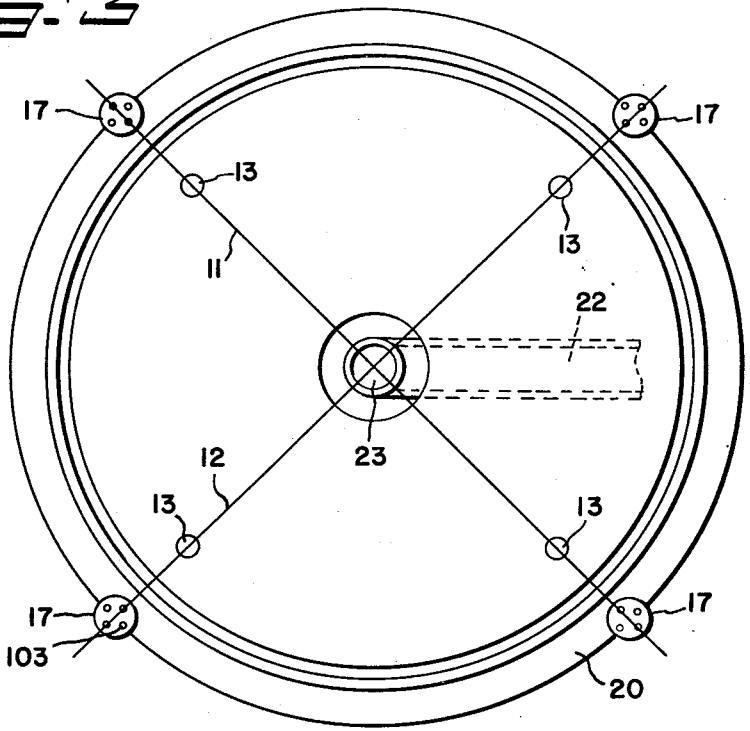
FIG. 3 is a ground plan view illustrating the excavation in construction of the fixed steel concrete foundation with waterproof walls in accordance with the teachings of the present invention.

Referring more particularly to the drawings, shown therein is the construction of and the method for constructing an earthquake resistant, even loaded man-made land structure in accordance with the teachings of the present invention. After selecting a suitable location for the earthquake resistant, even loaded man-made land structure, the top soil 1 should be dug out and set aside for later use. A test hole 2 should be dug to further determine the suitability of the land. After test hole 2 has been dug, holes 3, 4, 5 and 6 which lay along lines which pass through hole 2 that are perpendicular to each other should be dug to ascertain the composition and stability of the earth. The stratigraphic composition and stability data should be determined and recorded from points 2, 3, 4, 5 and 6.

To start the construction of the man-made land in accordance with the teachings of the present invention, first position the construction lines 11 and 12 and fix the position of the construction lines 11 and 12 at ground level 14 by temporarily marking the position with stakes 13. Next measure the site so that the digging points 3, 4, 5 and 6 can be utilized for constructing the stage foundation posts 17. After the stage foundation posts 17 are built, extend the constructions lines 11 and 12 to the foundation posts 17 and remove the stakes 13. Now commence excavation of the trench 20 and preserve the soil which is dug out on a adjacent lot for later use.

Figure 4:
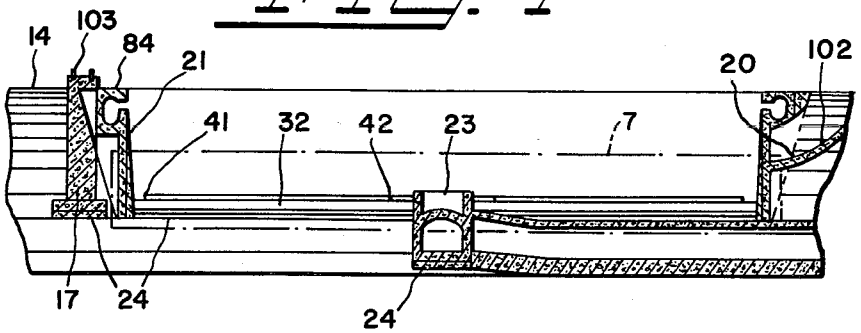
FIG. 4 is a cross section of FIG. 3.
Figure 1:
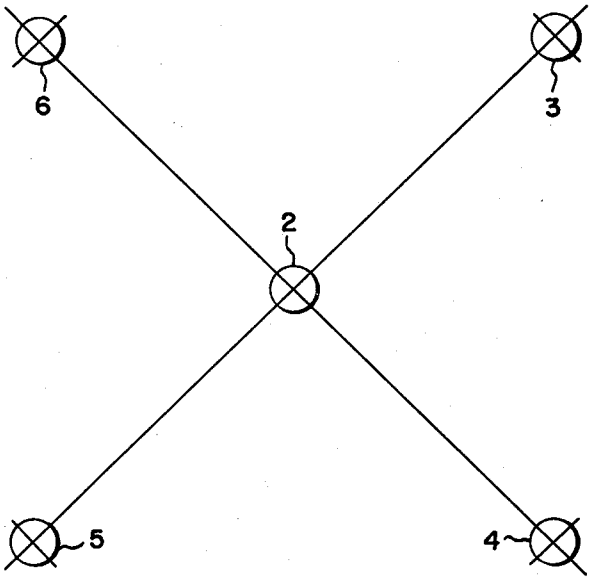
FIG. 1 is a ground plan for a test excavation after removing the top soil.
Figure 2:
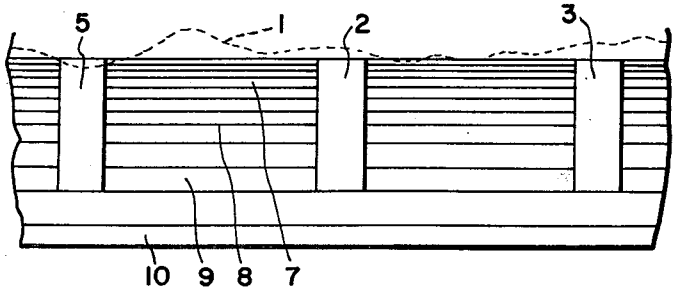
FIG. 2 is a cross-sectional view of FIG. 1.
Figure 5:
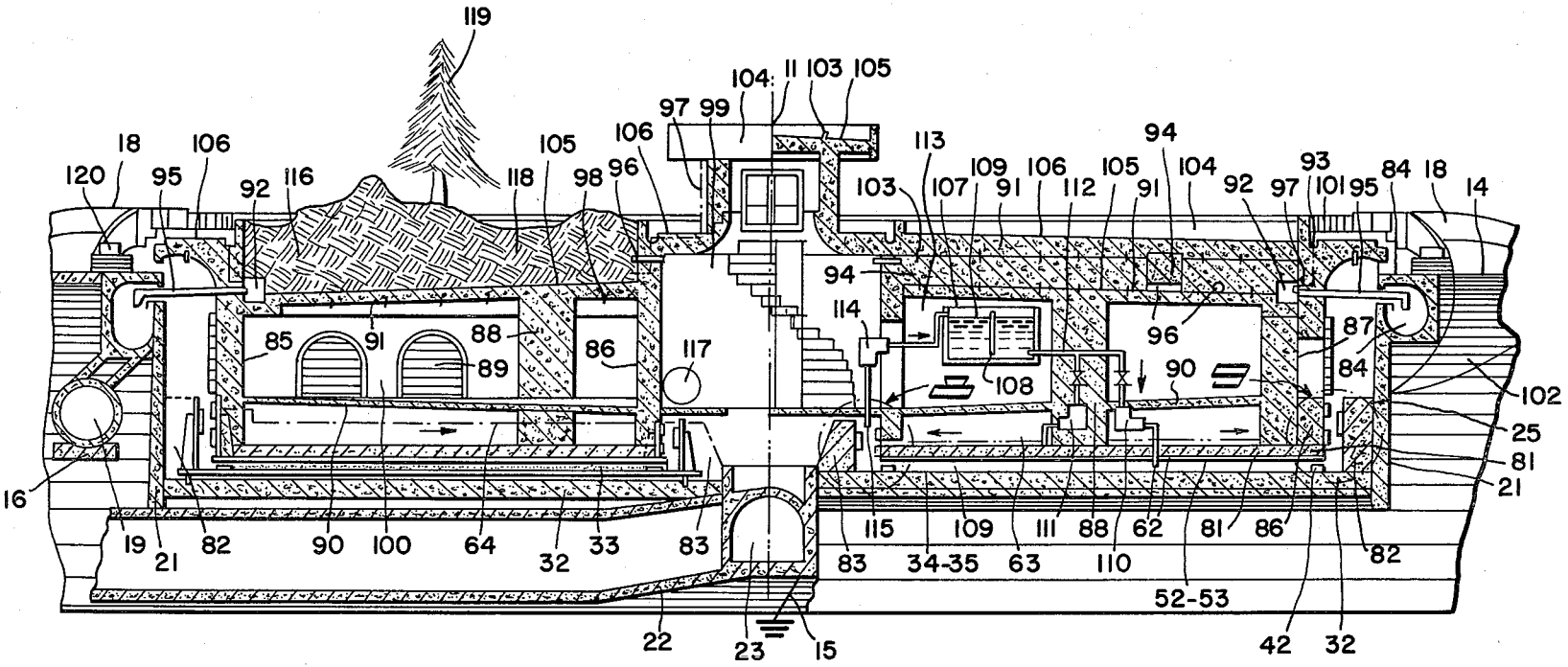
FIG. 5 is a cross-sectional view of an earthquake resistant man-made land structure in accordance with the teachings of the present invention.
Figure 5:
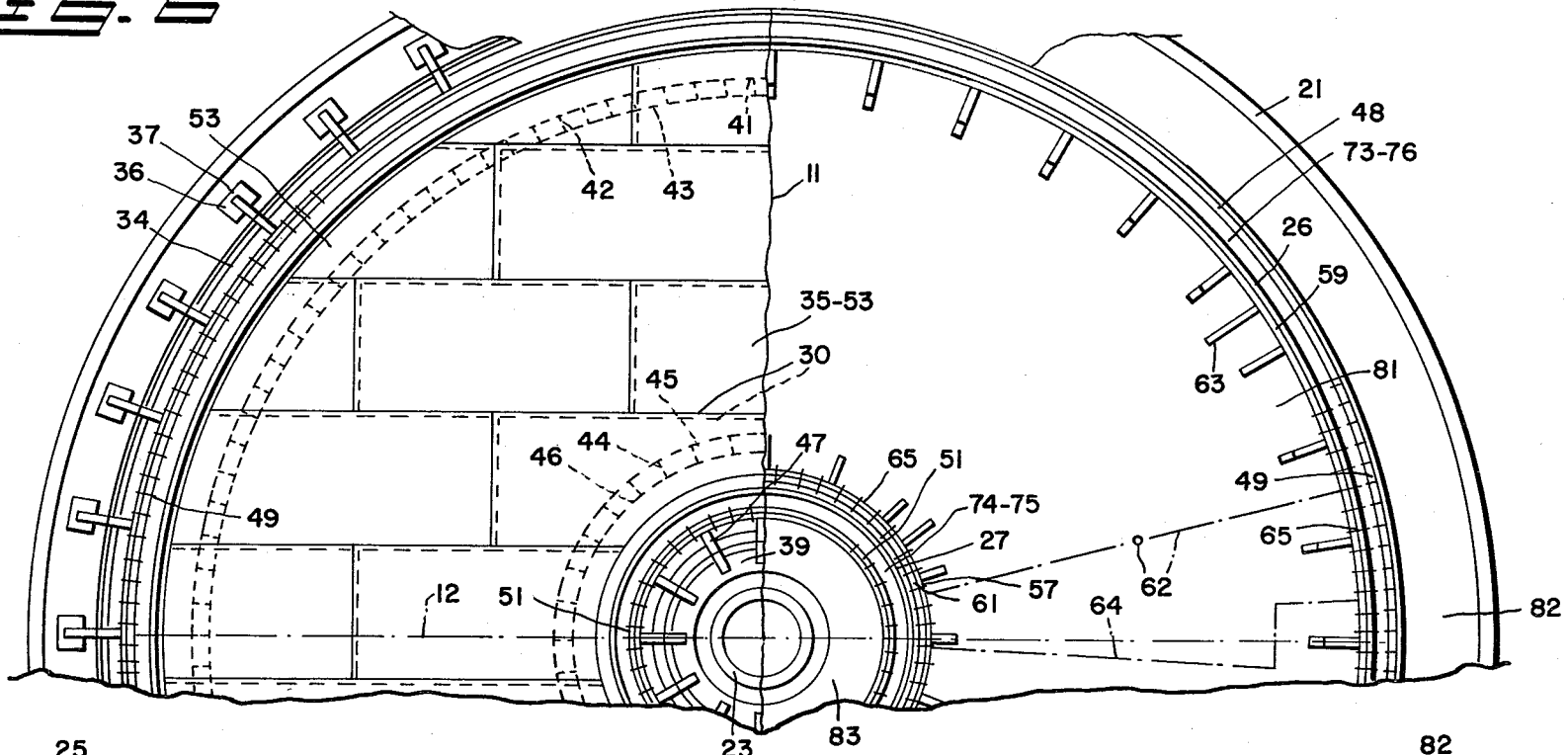

When the trench 20 is half done, commence construction of the waterproofing concrete wall 21, drainage ditch beams 84, drainage pipes 19 sitting on concrete port 16, the exterior common stake 23 and the subterranean path 102 so that their completion may coincide with the completion of the trench 20. When the waterproof concrete walls 21 are done, the trench 20 should be refilled halfway with gravel and dirt 9 preserved from the previous excavation. Begin the excavation for installing the common stake 23 as shown in FIGS. 3 through 5. So that the stake floor 22 and the common stake 23 will not be affected by the considerable weight they must bear, the common stake 23 and stake floor 22 should be completely connected. Before constructing the common stake floor 22 and the dead concrete 24 (in FIG. 4), it is necessary not only to accurately measure and document the zero resistance earth line but also to bury a grounding plate 15 no less than 1 meter below the common stake floor 22. Also, prior to constructing the fixed steel plate concrete foundation 32, reinforce the waterproof strata 25 inside the concrete walls 21 as shown in FIGS. 5 and 6 and pour the concrete mix for the dead concrete 24 to the marked level.

After several days install the steel reinforcing rods 28 for the fixed steel plate concrete foundation 32. Also install the dirt shield plates 26 and 27 and firmly connect them to the steel rods 28 with a weld 30 and paint with anti-rust paint. Double check the placement of the steel rods 28 and the shield plates 27 and 26 for a possible oversight and then pour the concrete for the fixed steel concrete foundation 32. Again after the passage of several days, clean the fixed steel foundation 32 and check again to be sure that the shield plates 26 and 27 are in correct position. Then carefully apply anti-rust paint on the inside and outside of the shield plates 26 and 27 and also apply a thick coat of waterproof paint to the surface of the concrete foundation 32. Next, insert the dry sand 33. Next, place each of the measured steel plates 35 of the work plates 34 on the upper surface of the shield plates 26 and 27 and arrange them to be completely level before being welded together. Then weld the plates 35 together to form the work plate 34 in the shape of a doughnut and then cut the work plate 34 with an oxyacetylene torch to fit. Next, the plates 35 and 53 should be grounded to the ground 15. Now the large ring plates 38 and 40 should be electrically coupled by the weld 30 to the work plate 34. Reinforcement plates 37 and 47 are coupled via weld 30 to the inside and outside walls respectively of the large ring plates 38 and 40. Furthermore, the reinforcement plates 37 and 47 should be drilled for concrete use. Next, reinforcement plates 36 and 39 should be coupled to the base of reinforcement plates 37 and 47 by electric welds 30 and should be placed respectively adjacent the shield plates 26 and 27. Next in order is to couple the thick ring plates 48 and 51 respectively by electric welds 30 to the inside and outside walls of large plates 38 and 40. When this is completed, drill a hole for a bolt 49 through the thick plates 48 and 51 and the large ring plates 38 and 40. Rivet type bolt 50 should be inserted through the hole in the large plates 38 and 40 and the thick plates 48 and 51.

Figure 7:
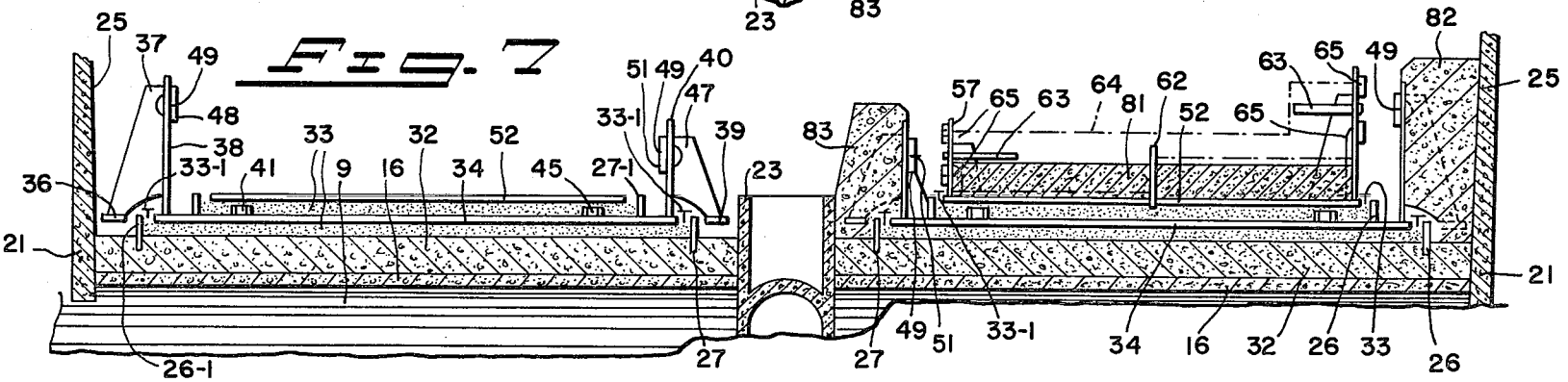
FIG. 7 is a cross section of FIG. 6.
Figure 5:
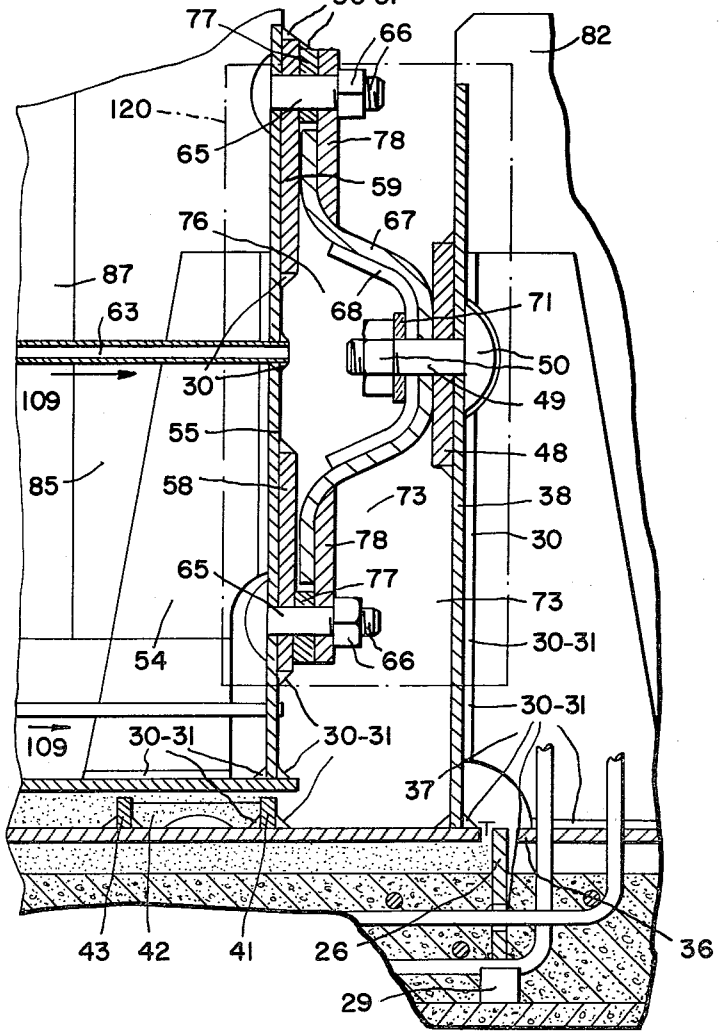
Figure 4:
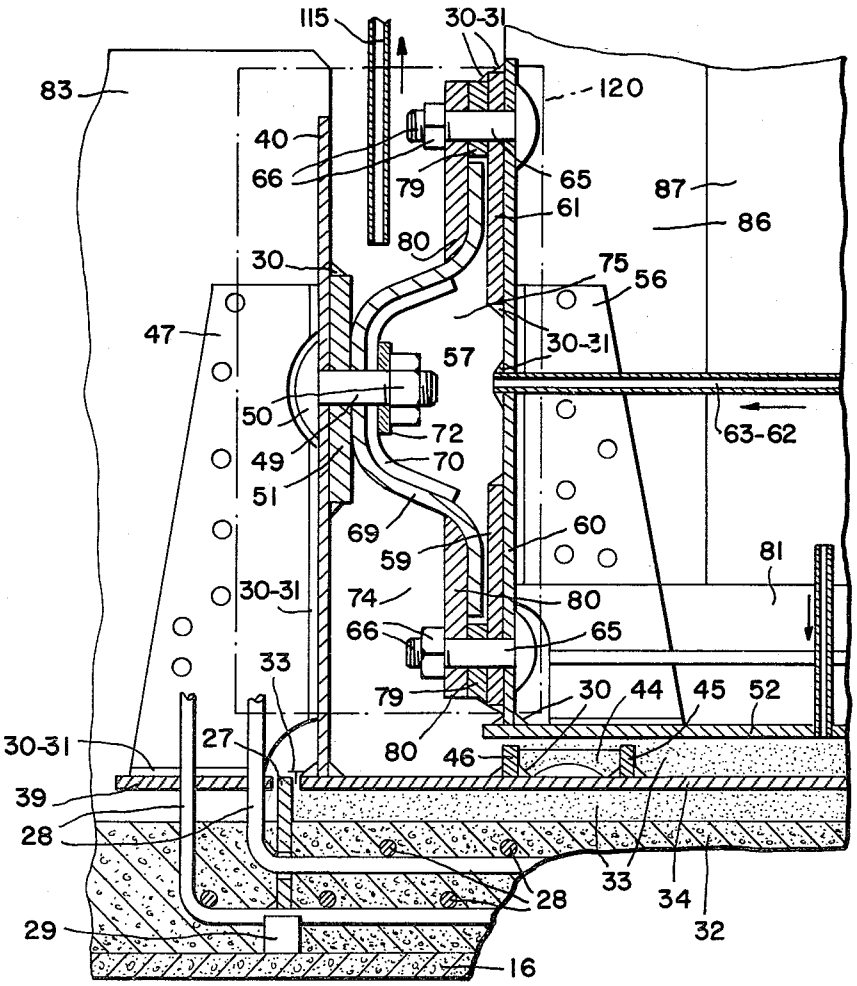
Figure 10:
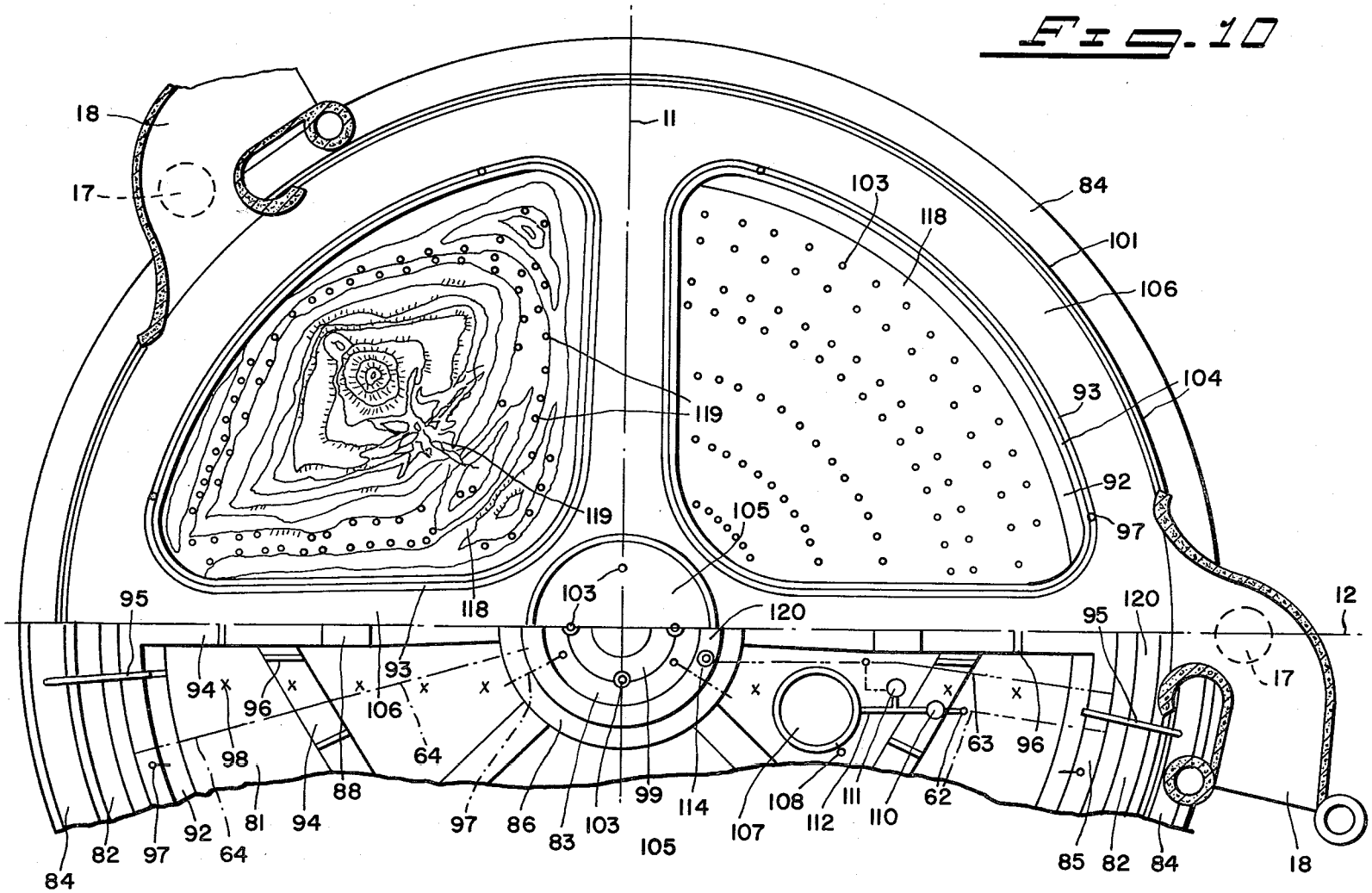
FIG. 10 is a ground layout of the earthquake resistant man-made land in accordance with the teachings of the present invention.
Figure 11:
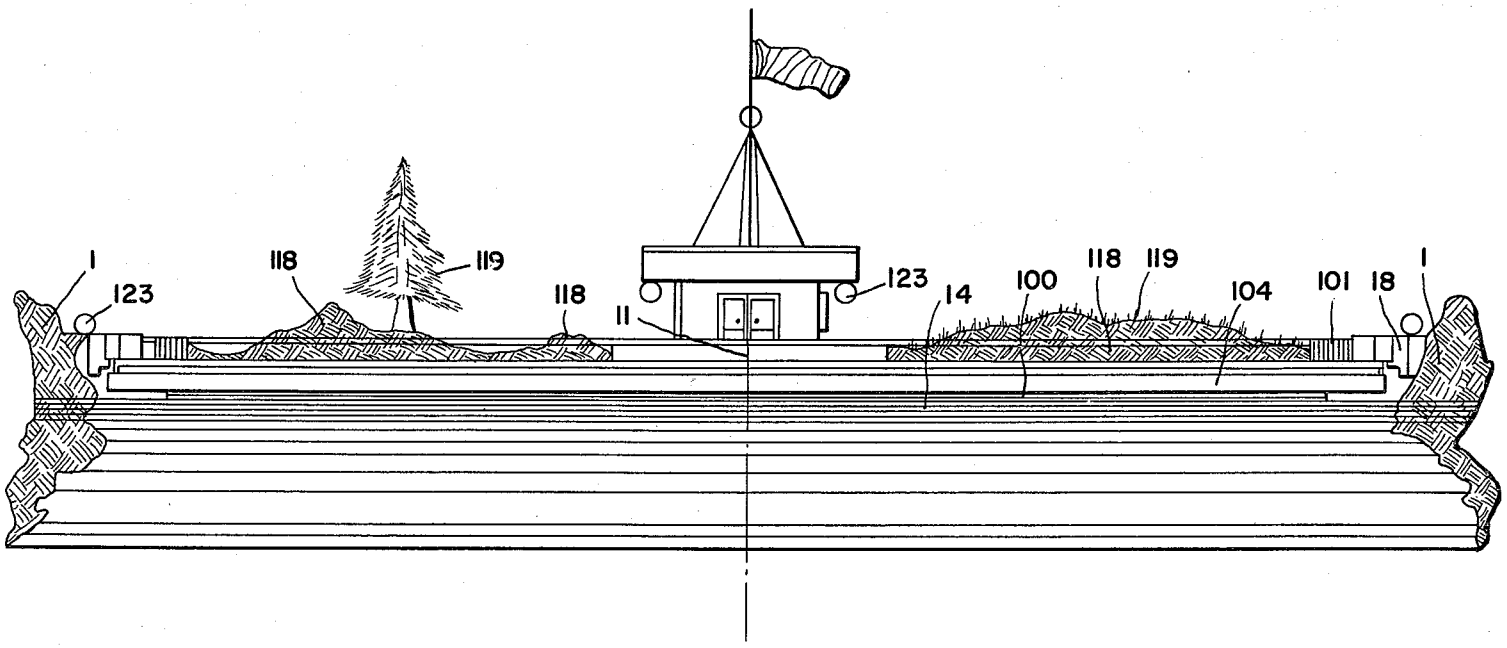
FIG. 11 is a sketch illustrating the completed man-made land in accordance with the teachings of the present invention.

Next, the shield plates 41, 42, 43, 44, 45 and 46 should be arranged on the work plate 34 as shown in FIGS. 6 and 7 before welding. Before welding the shield plates 41 through 46 to the work plate 34, the work plate 34 should be checked for drainage. Next, shield plates 26-1 and 27-1 should be arranged on the work plates 34 and before being coupled to the work plate 34 by electric weld 30 the shield plates 26-1 and 27-1 should each be checked for drainage.

Next, clean the work plate 34 and apply anti-rust paint to each surface of the large ring plates 38 and 40 and the work plate 34. As was previously done with the sub-strata sand 33, fill the space between the shield plates 26-1 and 27-1 with dry sand 33. Now position the measured plates 53 of the work plate 52 in the form of a rough doughnut on top of the sand 33 and weld the measured plates 53 together. Next, cut the work plate 52 to fit with an oxyacetylene torch. It should be pointed out that the quantity of dry sand 33 placed in the space between shield plate 26-1 and 27-1 depends upon the height desired for the work plate 52. In the preferred embodiment the height should be such that the work plate 52 is 30 mm away from the surface of the shield plates 41 through 46 and should substantially fill the space between shield plates 26-1 and 27-1.

Next, large plates 55 and 57 and reinforcement plates 54 and 56 are placed on work plate 52 and coupled to work plate 52 by weld 30. Furthermore, thick ring plates 58, 59, 60 and 61 are respectively coupled to large ring plates 55 and 57 by welds 30. Next, drill the holes for the bolts 65 and the high and low pressure pipes 62 and 63 in the large plates 55 and 57. Couple the connecting pipes 64 and low and high pressure pipes 62 and 63 to the large ring plates 55 and 57 by welds 30. Insert rivet type bolts 65 through the holes in the large plates 55 and 57 and install necessary short pieces of S-shaped concrete reinforcing rod 28 and the metal fixtures like the dowels 29.

Before installing the pipes, each of the pipes 62, 63 and 64 should be made as short as possible so that the rods 28 and the temporary concrete pouring frame works are easy to install. After the work plates 52, the floating foundation steel concrete 81, the exterior walls 85 and the interior wall 86 of the foundation steel concrete 81 and the steel rods 28 are put in their proper position, the pipes can be connected together by means of short lengths of pipe and pipe connectors. After applying the anti-rust paint 31 on all surfaces, the remaining steel rods 28 for post 87, exterior walls 85 and base 52 should be installed in their proper position. For installing the rods 28 use the S-shaped concrete steel and short pieces of concrete steel according to the steel placement of the thick steel concrete foundation 32. Next, examine the placement of the dowels 29 for possible mistake.

Now pour the cement mix for the floating steel concrete foundation 81, as per FIGS. 6 and 7. The pouring of the concrete foundation 81 should be finished the same day it is started. Since the sub-strata sand 33 and the work plates 34, which are already in a fixed position, are subjected to a considerable amount of weight and pressure brought about by the weight, 1–2 tons per $m^2$, of the floating concrete steel foundation 81, damage maybe unavoidable in the future to the fixed steel concrete foundation 32, the exterior walls 82 of the fixed steel concrete foundation 32 and the interior walls 83 of the fixed steel concrete foundation 32. Hence, steel rods 28 should be used which maintain the placement of the anti-earthquake hydraulic pressure and load on the inside and outside walls 82 and 83 of the fixed steel concrete foundation 32 as shown in FIGS. 6 and 7.

As shown in FIGS. 8 and 9, the steel rods 28 exposed from the fixed steel concrete foundation 32 (the short pieces of the S-shaped concrete steel) should be welded by welds 30 to the sides of the large ring plates 38 and 40. In the spaces between the shield plates 26 and 27 and the work plates 34, place gum-backed styrofoam packings 33-1 and install temporary frameworks before pouring the concrete mix. Also, the upper portion of the exterior walls 82 which are connected to the subterranean path 102 should be graded for drainage.

After the concrete has been poured and has been allowed to set for several days, remove the temporary frameworks and drill the clip steel belts 77, 78, 79 and 80 of the anti-oil-pressure packing equipment 120. Insert the bolts 65 protruding from the sides of the thick ring plates 58 and 60 through the holes in the clip steel belts 77, 78, 79 and 80 and tighten up the nuts 66 on the bolts 65. Afterwards, insert or apply hard grease into the space of the clip steel belts 77, 78, 79 and 80 and fill 1/5 of the space thereof. Clean the chambers 73 and 74 before and after greasing and insert the ends of the pair of packings or seals 67 and 69 into the greased openings of the clipped steel belts 77, 78, 79 and 80. Next, apply the cloth belt backings 68 and 70 which are C-shaped to the packings 67 and 69. Insert the bolts 50 through the holes in the packings 67 and 69, cloth belt backings 68 and 70 and apply base steel belts 71 and 72 and nuts 50. During the installation of the packings 67 and 69 and before the bolts 50 and 65 are tightened, the cloth belt backings 68 and 70 should be joined to the packings 67 and 69 with gum adhesive and the packings 67 and 69 should be coupled to respectively to the thick ring plates 59 and 61 with gum adhesive. Furthermore, gum adhesive should be applied to the side of the steel belts 77 and 79 and apply hard grease on both sides of end of the packings 67 and 69 before inserting them into the space of the steel belts 77, 78, 79 and 80. Next, tighten the nuts 66 and 50. Special care should be taken when tightening the nuts not to allow any foreign elements to remain in the chambers 75 and 76.

It is important to bear in mind that the installation of the construction bridges 18 and the construction of the passage leading to the bridges 18 and the subterranean path 102 should likewise be executed. Such construction should be executed usually prior to or in parallel to the placement of the steel rods 28 as well as the temporary frame works for the body of the man-made land according to the teachings of the present invention. Next, as shown in FIGS. 5, 8 and 9, the anti-earthquake interior walls 86 of the floating steel concrete foundation 81, the exterior walls 85 of the floating steel concrete foundation 81, the posts 87 of the floating steel concrete foundation 81, the independent posts 88, the underground entrance 89, the underground slabs 90 (with an opening for a machine shop), the resistance slabs 91, the drains 92 and 93, the body beams 94, the entrance and the pipe shafts 99 and the dressing sides 104 should be completed in accordance with the placement of the steel rods 28. The setting up of the general frameworks of the land body, the thick drain pipes 95 and 96, the pipes 97, the starter 98, the anchor bolts 103, the pilot light 123, the vibroscope 117, the power supply pipes and the ground 15 should all be checked before installation is complete for possible oversight. After ten days all supports should be removed and cleaned and the construction of the resistance slabs 91, the drains 92 and the waterproof asphalt strata 105 should be commenced as per FIG. 5. Next, install the safety metal guards 105 for safe passage around the land body 100 before completing the asphalt paved floors 106 and the dressing sides 104. Also, apply anti-rust paint 31 to the anchor bolts 103 which are planted in the pressure resistance slabs 91.

After tightening up all the nuts cover them with protective caps as a precaution. In addition, the thick drain pipes 95 and 96 and the drains 92 and 93 should be covered with a meshed metal cover to prevent the entry of dirt. One end of pipe 96 should be sealed and it should be fixed to the resistance slab 91 with glue. The drain pipe 95, the pipes 97 and the underground entrance shutter 89 should be attached firmly to the anchor bolts 103 or the starter fixture 98. In the machine room 113, as shown in FIG. 5, install the oil tank 107 and the high and low pressure pumps 111 and 110 and the drain motor pump 114. Also coupled together the pipes 62, 63, 64, 112 and 115 together with the high and low pressure pumps 111 and 110 and the drain pump 114. Next, add the required amount of oil 109 to the oil tank 107.

To test the system, turn on the pumps 110 and 111 and continuously run the high and low pressure pumps 110 and 111 until the oil 109 fills up the chambers 73 and 74 as well as the chamber 75 and 76 of the anti-oil-pressure equipment together with the upper layer of sand 33. Now stop the high and low pressure pumps 110 and 111. Refill the oil tank 107 with oil 109 to the level indicated by the oil gauge on tank 107. Switch off the temporary power source for the high and low pressure pumps and check and record any leakage of oil 109 from the chambers 73, 74, 75 and 76. Correct and repair promptly any leaks which are uncovered during the test and turn on the drain motor pump 114 connected to the drain pipe 115 as well as the collecting system of the anti-oil-pressure equipment 120 to see if they are defective. If the leaking of oil 109 is small, the installation is correct. Now again examine the land body in its entirety and install the ground terminal box, electric wiring pipes, boxes switches, vibroscope, power source and illuminating lighting system for the underground paths 102, the basement and the machine shop 113.

Next, place thick vinyl sheets on top of the resistance slabs 91, as shown in FIG. 5, to help the drainage and to prevent any damage to the waterproof asphalt layer 105. Next, provide such layers 116 and in the following order, soft dirt 7 first and then top soil 1, add the dirt 9 which has been preserved from the excavation for the trench 20. Next mix the rich black soil with the top soil 1 or the soft dirt 7 to make the fertile soil 118 and install trees 119.

In operation, the hydraulic pressure in the sand 33 and the chambers 73 and 74 act to support and isolate the man-made land from the surrounding earth and in this way almost completely eliminates the effects of earthquakes upon any structure or vegetation provided on the man-made land.

It should be apparent to one skilled in the art that while the man-made land of the present invention has been described in terms of a circular area, it would be equally possible to construct the man-made land in the shape of rectangle square, or other figure.

It should be also apparent to one skilled in the art that the above-described embodiment is merely illustrative but one of the many possible specific embodiments which represent the application of the principles of the present invention. Numerous and various other arrangements can be readily devised by those skilled in the art without departing from the spirit and scope of the invention.

I claim:

1. An earthquake resistant, even loaded man-made land structure comprising:

an open container having a bottom and side walls provided in the earth;

a plate slidably provided in and substantially closing the open end of said container;

at least one layer of sand provided between a bottom surface of said plate and said bottom of said container;

a means for introducing hydraulic fluid into said sand and for maintaining said hydraulic fluid under pressure; and dirt provided on top of said plate in said container.

2. An earthquake resistant, even loaded man-made land structure comprising:

an open first container provided in the earth, said open first container having a bottom, side walls and a central column;

a first layer of sand provided in said bottom of said first container;

a first plate provided on said sand and coupled to said central column and side walls of said first container;

a second layer of sand provided on top of said first plate;

a second plate provided on said second layer of sand;

a resilient hydraulic seal means provided between said second plate and said side walls and between said second plate and said central column;

a hydraulic fluid means for introducing hydraulic fluid under pressure into said second layer of sand and said resilient hydraulic seal means;

a second container provided on said second plate; said second container being independent from said first container; and dirt provided in said second container.

3. A man-made land structure according to claim 2 wherein said hydraulic fluid means comprises:

a hydraulic fluid reservoir;

a high pressure hydraulic fluid pump for pumping said hydraulic fluid under high pressure; and a low pressure hydraulic fluid pump for pumping said hydraulic fluid under low pressure.

4. A man-made land structure according to claim 3 wherein said first container is made from concrete.

5. A method for making an earthquake resistant, even loaded man-made land structure comprising the steps of:

providing an open first container in the earth, said open first container having a bottom and side walls;

providing a first layer of sand in said bottom of said first container;

providing a first plate on said first layer of sand and coupled to said side walls;

providing a second layer of sand on top of said first plate;

providing a second plate on said second layer of sand;

installing a resilient hydraulic sealing means between said second plate and said side walls;

introducing hydraulic fluid under pressure into said second layer of sand and said resilient hydraulic sealing means;

forming a second container on said second plate; and filling said second container with dirt.

* * * * *